US008250892B2

(12) United States Patent
Zak et al.

(10) Patent No.: US 8,250,892 B2
(45) Date of Patent: Aug. 28, 2012

(54) CLOSURE DEVICE FOR EXPLOSION FORMING

(75) Inventors: Alexander Zak, Moedling (AT); Valentine Flitsch, Hart bei Graz (AT); Andreas Stranz, Reichenau (AT)

(73) Assignee: Cosma Engineering Europe AG, Oberwaltersdorf (AT)

( * ) Notice: Subject to any disclaimer, the term of this patent is extended or adjusted under 35 U.S.C. 154(b) by 632 days.

(21) Appl. No.: 12/517,126

(22) PCT Filed: Oct. 19, 2007

(86) PCT No.: PCT/EP2007/009113

§ 371 (c)(1),
(2), (4) Date: Jun. 1, 2009

(87) PCT Pub. No.: WO2008/064746

PCT Pub. Date: Jun. 5, 2008

(65) Prior Publication Data

US 2010/0064752 A1 Mar. 18, 2010

(30) Foreign Application Priority Data

Dec. 1, 2006 (DE) ..... 10 2006 056 788

(51) Int. Cl.
*B21D 26/00* (2006.01)
*B21J 5/04* (2006.01)

(52) U.S. Cl. ..... 72/56; 72/61; 72/430; 72/706; 29/421.2

(58) Field of Classification Search ..... 72/54, 56, 72/61, 430, 706; 29/421.2
See application file for complete search history.

(56) References Cited

U.S. PATENT DOCUMENTS

| | | | | |
|---|---|---|---|---|
| 392,635 | A | 5/1933 | Powers | |
| 3,160,949 | A | 12/1964 | Bussey et al. | |
| 3,252,312 | A | 5/1966 | Maier | |
| 3,342,048 | A | 9/1967 | Johnson et al. | |
| 3,600,921 | A | 8/1971 | Schwarz | |
| 3,640,110 | A | 2/1972 | Inoue | |
| 3,654,788 | A | 4/1972 | Kimura | |
| 3,661,004 | A | 5/1972 | Lee et al. | |
| 1,280,451 | A | 7/1972 | Hagen | |
| 3,737,975 | A | 6/1973 | McKinnon, Jr. | |
| 3,742,746 | A | 7/1973 | Erlandson | |
| 4,187,709 | A | 2/1980 | Legate et al. | |
| 4,471,640 | A * | 9/1984 | Kortenski et al. | 72/56 |
| 4,492,104 | A | 1/1985 | Weaver et al. | |
| 4,494,392 | A | 1/1985 | Schroeder | |
| 4,571,800 | A | 2/1986 | Faupell | |

(Continued)

FOREIGN PATENT DOCUMENTS

| | | |
|---|---|---|
| AT | 248838 | 8/1966 |

(Continued)

*Primary Examiner* — David B Jones
(74) *Attorney, Agent, or Firm* — Dickinson Wright PLLC

(57) ABSTRACT

Through the invention, a closure device for explosive forming with a connection unit movable relative to the explosive forming die between a working position on the die and a rest position is to be configured, so that the explosive forming die can be closed in simple and reliable fashion and, at the same time, the explosion forces supported. This task is solved by a closure device, in which a wedge structure is guided to move on a static holding structure and is motion-coupled to the connection unit, the resulting movement of the connection unit being directed across the movement of the wedge structure.

27 Claims, 4 Drawing Sheets

U.S. PATENT DOCUMENTS

| | | | | |
|---|---|---|---|---|
| 4,738,012 | A | 4/1988 | Hughes et al. | |
| 4,788,841 | A | 12/1988 | Calhoun et al. | |
| 4,856,311 | A | 8/1989 | Conaway | |
| 5,187,962 | A | 2/1993 | Bilko et al. | |
| 5,220,727 | A | 6/1993 | Hochstein | |
| 5,339,666 | A | 8/1994 | Suzuki et al. | |
| 5,377,594 | A | 1/1995 | Alford | |
| 5,890,698 | A | 4/1999 | Domytrak | |
| 8,047,036 | B2 * | 11/2011 | Trubert et al. | 72/56 |
| 2006/0060601 | A1 | 3/2006 | Kubacki et al. | |

FOREIGN PATENT DOCUMENTS

| | | | |
|---|---|---|---|
| AT | 276032 | | 11/1969 |
| AT | 371384 | | 6/1983 |
| CH | 409831 | | 10/1966 |
| DE | 1452667 | U | 12/1938 |
| DE | 1218986 | | 1/1967 |
| DE | 1235246 | B1 | 3/1967 |
| DE | 1129562 | | 10/1968 |
| DE | 1452665 | A1 | 5/1969 |
| DE | 1452667 | A1 | 5/1969 |
| DE | 1527949 | A1 | 11/1969 |
| DE | 1801784 | A1 | 6/1970 |
| DE | 1808942 | A1 | 6/1970 |
| DE | 2043251 | | 9/1970 |
| DE | 1777207 | A1 | 4/1971 |
| DE | 1777208 | A1 | 4/1971 |
| DE | 2043251 | | 3/1972 |
| DE | 2059181 | A1 | 6/1972 |
| DE | 2107460 | A1 | 8/1972 |
| DE | 2357295 | A1 | 5/1974 |
| DE | 2337176 | A1 | 6/1975 |
| DE | 114231 | | 7/1975 |
| DE | 2622317 | A1 | 1/1977 |
| DE | 2628579 | A1 | 12/1977 |
| DE | 2908561 | A1 | 10/1979 |
| DE | 158364 | | 12/1983 |
| DE | 3341488 | A1 | 5/1984 |
| DE | 3305615 | A1 | 8/1984 |
| DE | 217154 | A1 | 1/1985 |
| DE | 3590248 | C2 | 6/1986 |
| DE | 3512015 | A1 | 10/1986 |
| DE | 260450 | A1 | 9/1988 |
| DE | 3709181 | A1 | 9/1988 |
| DE | 4035894 | C1 | 1/1992 |
| DE | 4232913 | C2 | 4/1994 |
| DE | 19536292 | | 4/1997 |
| DE | 19638679 | A1 | 3/1998 |
| DE | 19638688 | A1 | 3/1998 |
| DE | 19709918 | A1 | 9/1998 |
| DE | 19818572 | C1 | 11/1999 |
| DE | 19852302 | A1 | 5/2000 |
| DE | 19915383 | B4 | 10/2000 |
| DE | 19957836 | A1 | 6/2001 |
| DE | 10328154 | A1 | 12/2004 |
| DE | 102005025660 | A1 | 12/2006 |
| DE | 102006056788 | | 12/2006 |
| DE | 102007007330 | | 2/2007 |
| DE | 102007023669 | | 5/2007 |
| DE | 102006008533 | A1 | 8/2007 |
| DE | 102007036196 | | 8/2007 |
| DE | 102006019856 | A1 | 11/2007 |
| DE | 102006037754 | B3 | 1/2008 |
| DE | 102008006979 | | 1/2008 |
| DE | 102006037742 | A1 | 2/2008 |
| DE | 102006060372 | A1 | 6/2008 |
| EP | 0151490 | A2 | 8/1985 |
| EP | 148459 | B1 | 11/1987 |
| EP | 0288705 | A2 | 11/1988 |
| EP | 00371018 | B1 | 7/1992 |
| EP | 0592068 | A1 | 4/1994 |
| EP | 0590262 | B1 | 4/1996 |
| EP | 0765675 | A2 | 4/1997 |
| EP | 0830906 | A1 | 3/1998 |
| EP | 0830907 | A2 | 3/1998 |
| EP | 1702695 | A2 | 9/2006 |
| EP | 1849551 | A2 | 10/2007 |
| FR | 1342377 | A | 9/1963 |
| FR | 2300322 | A1 | 2/1975 |
| FR | 2280465 | | 2/1976 |
| FR | 7503396 | | 9/1976 |
| GB | 742460 | | 6/1952 |
| GB | 878178 | A | 9/1961 |
| GB | 1129562 | A | 10/1968 |
| GB | 1280451 | A | 7/1972 |
| GB | 1419889 | | 12/1975 |
| GB | 1436538 | | 5/1976 |
| GB | 1501049 | A | 2/1978 |
| GB | 1542519 | A | 3/1979 |
| GB | 2009651 | A | 6/1979 |
| GB | 2047147 | A | 11/1980 |
| JP | 55-139128 | A | 10/1980 |
| JP | 58145381 | A | 8/1983 |
| JP | 2117728 | A | 5/1990 |
| JP | 739958 | | 2/1995 |
| JP | 70505176 | | 2/1995 |
| JP | 2001054866 | A | 2/2001 |
| JP | 2002093379 | A | 3/2002 |
| JP | 2007-222778 | A | 9/2007 |
| WO | 9933590 | A2 | 7/1999 |
| WO | 0000309 | A1 | 1/2000 |
| WO | 2004028719 | A1 | 4/2004 |
| WO | 2006128519 | A | 12/2006 |
| WO | 2008098608 | A1 | 8/2008 |
| WO | 2009095042 | A1 | 8/2009 |

* cited by examiner

CLOSURE DEVICE FOR EXPLOSION FORMING

CROSS-REFERENCE TO RELATED APPLICATIONS

This application is a national entry application of PCT Application WO 2008/064746 filed on Oct. 19, 2007, entitled "Closure Device For Explosion Forming" which claims priority from German Patent No. 10 2006 056 788 filed on Dec. 1, 2006, entitled "Verschlusseinrichtung für das Explosionsumformen" (Closure Device For Explosion Forming), the disclosures of which are incorporated herein by reference for all purposes.

FIELD OF THE INVENTION

The invention relates to a closure device for explosive forming.

BACKGROUND OF THE INVENTION

During explosive forming, a generally tubular work piece is plastically widened by the developing internal pressure. Before the forming process, the work piece is situated in a closed die and then forced against the die cavity by the internal pressure. The high internal pressure required for this forms by ignition of a gas mixture in the interior; at detonation velocities to 5000 m/s, the die must withstand forces equivalent to about 400 t. Tight closure of the forming die is therefore of special significance for explosive forming.

An explosive forming method is described in the subsequently published German Patent Application 10 2005 025 660 "Device and Method for Explosive Forming." The described device is used, in particular, to form a seal between the closed die and the tube-like work piece by a conical plug. This plug forms the continuation of an ignition tube, which can be moved between a work position against the die and a rest position at a standoff from the die. For this purpose, the force and stroke of a hydraulic cylinder are transmitted by a control element. In the laterally opened control element operated by the hydraulic cylinder, an oblique groove is situated for the ignition tube and an axially running straight groove for an engagement element. The axially guided ignition tube is moved over the oblique groove by movement of the control element. The engagement element is not engaged by movement of the control element, since it is guided to move in the straight groove.

SUMMARY OF THE INVENTION

The underlying task of the invention is to configure a closure device for explosive forming, with which an explosive forming die can be closed and the explosion forces supported in a simple and reliable manner by means of a movement of a connection unit.

This task is solved according to the invention by a closure device for explosive forming of a work piece. The closure device includes an explosive forming die that defines a cavity for forming the work piece. A connection unit is moveable relative to the explosive forming die along an axis between a working position and a rest position. In the working position, the connection unit is moved towards the explosive forming die to situate the connection unit on the explosive forming die. In the rest position, the connection unit is moved away the explosive forming die. A static holding structure is disposed about at least a portion of the connection unit. A wedge structure engages the connection unit and is disposed within the static holding structure. The wedge structure is moveable relative to the static holding structure transverse to the axis to move the connection unit between the working position and the rest position.

The static holding structure, as an additional element, permits separation of the two functions, fastening of the closure device on the molding die and wedge-transmitting motion coupling between the wedge structure and the connection unit. Guiding of the moving wedge structure on the static holding structure permits a uniform motion process of same, despite high activation and explosive forces. In addition, these forces acting transversely partly through the bypass can be supported laterally on the static holding structure.

In a favorable practical example, the static holding structure encloses the wedge structure like a frame. At the occurring significant explosive forces, this can contribute to stability and torsional stiffness of the closure device and ensure roughly equivalent alignment of the components relative to each other.

In a special variant of the invention, sliding aids are provided on the surfaces moved relative to each other between the wedge structure and the static holding structure. These sliding aids can support uniform movement of the wedge structure on the static holding structure and promote force support via the static holding structure.

Advantageously, these sliding aids are metallic antifriction coatings. Metallic antifriction coatings withstand high occurring forces, as here during activation and as a result of the explosion.

In a particularly favorable variant, the static holding structure is fastened to the explosive forming die. The static holding structure can therefore be supported on the explosive molding die and remain static in its position relative to the die, despite the closure and explosive forces.

It can be advantageous to connect the static holding structure by at least one anchoring element to the explosive molding die. The static holding structure can therefore be reliably and effectively supported on the explosive molding die.

The at least one anchoring element can be mounted especially on the static holding structure in at least one shape-mated receptacle. The closure and explosive forces can be reliably transferred via engagement.

In an advantageous variant, movement of the connection unit is guided on the anchoring element. This guarantees reliable alignment of the movement of the connection unit relative to the die and the static holding structure.

Advantageously, friction-reducing intermediate elements are provided on the surfaces moved relative to each other between the connection unit and the anchoring element, in order to be able to support uniform movement of the connection unit on the anchoring element.

The friction-reducing intermediate elements are advantageously metallic antifriction coatings, which have a long lifetime and limited wear at high loading forces.

In an advantageous variant, the wedge structure encloses the connection unit roughly U-shaped across the direction of movement of the connection unit. The forces acting on the wedge structure are therefore taken up well by it, in which case the movement of the connection unit is made possible.

The connection unit has at least one transfer element motion-coupled to the wedge structure across the direction of movement of the connection unit, on which the wedge structure is movable. The forces and movements of the wedge structure are transferred to the connection unit on the transfer element.

In a favorable variant, the wedge structure has a wedge guide, with which the at least one transfer element is engaged. The wedge guide is particularly suited for guiding the transfer element in it, without tilting.

In a favorable variant of the invention, the at least one transfer element and the at least one wedge guide are sloped in the same direction and to the same degree relative to the movement direction of the connection unit. This can improve transfer of forces and strokes and permit uniform movements of the transfer element in the wedge guide.

Advantageously, on the surfaces that are moved relative to each other, slide-promoting intermediate structures are provided between the at least one transfer element and the at least one wedge guide. This permits more effective force transfer between the transfer element and the wedge mount.

In a favorable practical example, the slide-promoting intermediate structures are metallic antifriction coatings. Metallic antifriction coatings are characterized by a general low attrition at high forces.

The wedge structure is advantageously moved by means of an operating element, especially a hydraulic actuator. The operating element can be selected according to the requirements in terms of force and stroke. Hydraulic actuators are suitable because of the high attainable forces connected with sufficient precision.

It can be advantageous that the operating element extends across the wall of the static holding structure. "Wall" in this sense means side, cover and/or bottom walls. Good access of the operating element to the wedge structure in the closure device is therefore guaranteed.

In a special variant of the invention, the closure device is fastened releasably to the explosive forming die as a unit. The closure device, depending on the application, can be mounted on a desired die and later optionally mounted on another die for a new application.

The static holding structure favorably has a roughly ring-like closed structure. Such closed structures can be extremely stable and torsionally stiff, which can be a major advantage at the forces occurring in explosive forming.

In one variant, the static holding structure is closed roughly ring-like by a yoke. The yoke closes the holding structure in reinforcing fashion and can ensure good accessibility to the parts situated in the static holding structure during assembly and disassembly. During manufacture, the mentioned multi-part characteristic can also be an advantage in terms of manufacturing demands and costs.

It is advantageous if the connection unit is supported to slide on the yoke. This additional guiding can support uniform movement of the connection unit and contribute to torsional stiffness of the entire device.

At least one of the surfaces moved relative to each other advantageously has at least one sliding element between the connection unit and the yoke. These additional elements can also have the advantage, in addition to reducing friction, of compensating manufacturing tolerances.

Favorably, the sliding elements have metallic antifriction coatings. In particular, metallic antifriction coatings can be produced with very close tolerances.

In a favorable practical example of the invention, the connection unit has two transfer elements and the wedge structure has two wedge guides across the direction of movement of the connection unit. The presence of two elements in engagement can ensure that force flow is divided and better supported.

In an advantageous variant, the connection unit has at least one gas feed unit and/or ignition device and/or die closure and/or die seal.

This and other objects of the invention can be more fully appreciated from the following detailed description of the preferred embodiments.

BRIEF DESCRIPTION OF THE DRAWINGS

Exemplary embodiments of the invention will now be described in conjunction with the following drawings wherein like numerals represent like elements, and wherein.

DETAILED DESCRIPTION OF THE PREFERRED EMBODIMENTS

The same reference numbers refer to the same parts or features, regardless of the figure in which they are shown.

Figure 1:
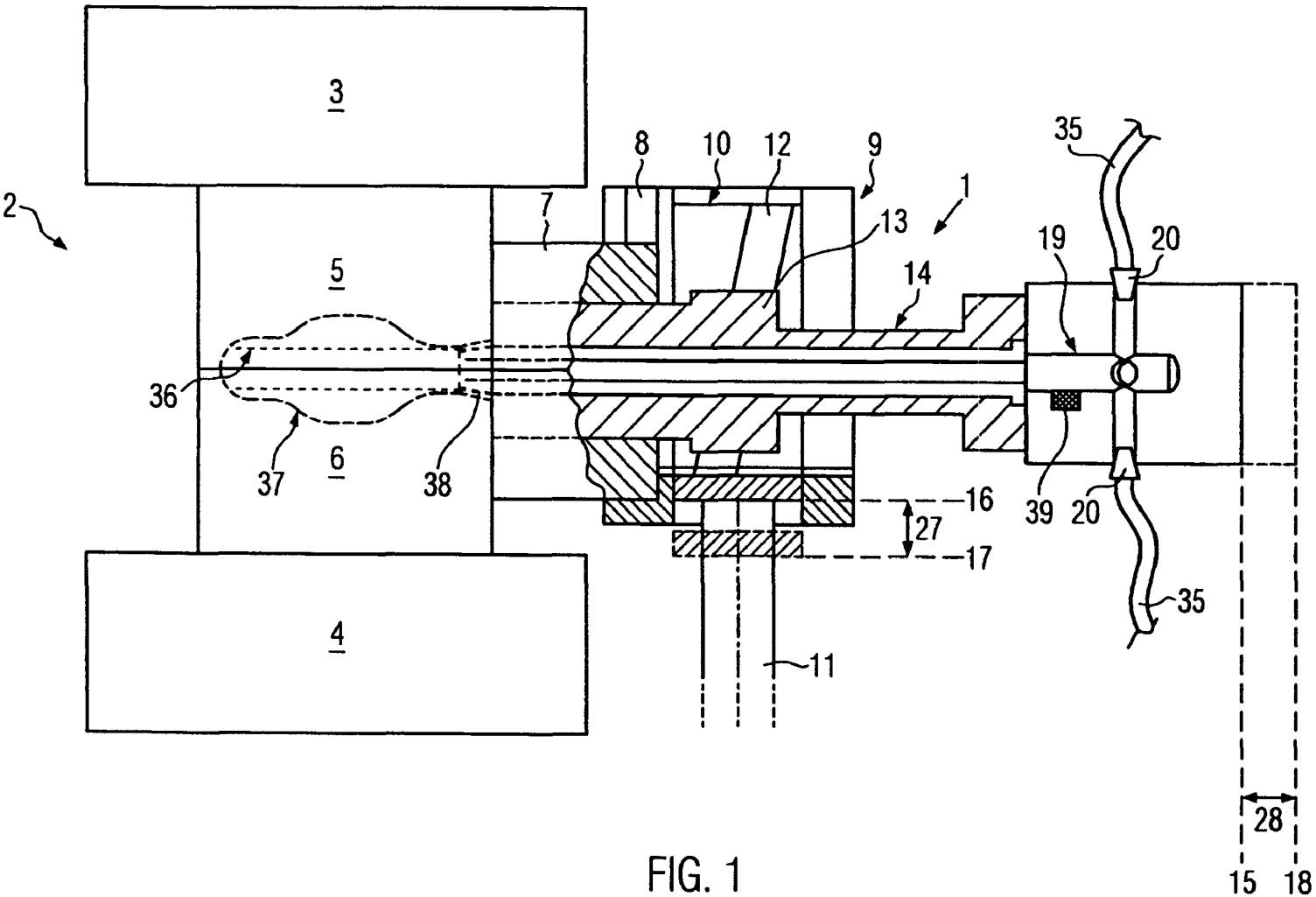
FIG. 1 schematically shows the principle of the invention with a partial section through the closure device.

FIG. 1 schematically depicts a partial section through a closure device for explosive forming 1 in its position in a press 2 (not further detailed). The press is shown here highly simplified as upper 3 and lower 4 press halves, between which an explosive forming die is situated with an upper 5 and lower box 6. A work piece 36 to be formed and shown with a dashed line is still spaced from a cavity 37 (shown with a dashed line) of the die 5, 6, which determines its final shape. A slightly conical or cylindrical plug 38, also shown with a dashed line, widens the work piece 36 on one end and therefore tightens it relative to die 5, 6. This plug 38 serves for die closure and sealing of die 5, 6.

The closure device 1 is connected to the explosive forming die 5 and 6 via an anchoring element 7. This anchoring element 7 is accommodated in a shape-mated receptacle 8 of a static holding structure 9. A wedge structure 10 is guided to move in the static holding structure 9, which is operated by a hydraulic actuator 11. The connection unit 14 with the plug 38 formed on it can be moved via a transfer element 13 guided in a wedge guide 12. The connection unit 14 is guided axially in the anchoring element 7, so that movements can only be transferred in this direction 28.

The ratio of the force to be applied to operate the wedge structure 10 to the resulting force that moves the connection unit 14 is about 3-5:1, especially 3.5-4.5:1, and, in particular, about 4:1. For this purpose, the wedge guide 12 is sloped about 60° to 85°, especially 75° to 80°, and, in particular, about 77°, relative to the movement direction 28 of connection unit 14. This guarantees a favorable force ratio, in order to properly take up brief high force peaks and thus hold the connection unit 14 in the desired position 15 even during the explosion. Depending on the slope of the wedge guide 12, the inertia of the wedge structure 10 also contributes to this task.

In a working position 15 of the connection unit 14, the connection unit 14 is situated on forming die 5 and 6 and the plug 38 in die cavity 37. Hydraulic actuator 11 is then also situated in its working position 16. If the hydraulic actuator 11 is now operated in direction 27, so that it is moved from its working position 15 into its rest position 17, shown by the dashed line, the wedge structure 10 moves to the same degree with the hydraulic actuator 11. The transfer elements 13 of connection unit 14 guided in wedge guide 12 are forced to movement 28 across the mentioned movement 27 of hydraulic actuator 11 and therefore wedge structure 10. Because of this, the connection element 14 executes an axial movement from its working position 15 into its rest position 18, shown by the dashed line, in which it is at a standoff from the forming die 5 and 6.

In the cross-section of connection unit 14, a gas feed and ignition system 19 with a straight ignition tube and transversely perforated gas feed lines is shown. The gas system 19 is supplied via corresponding lines 35 with valves 20. Ignition of the gas mixture occurs via an ignition device 39.

From the schematic view in FIG. 1, the movement coupling of the connection unit 14 over the working positions 15, 16 and rest positions 18, 17 of connection unit 14, shown with the dashed lines, as well as the operating wedge structure 10 and the hydraulic actuator 11, are shown.

Figure 2:
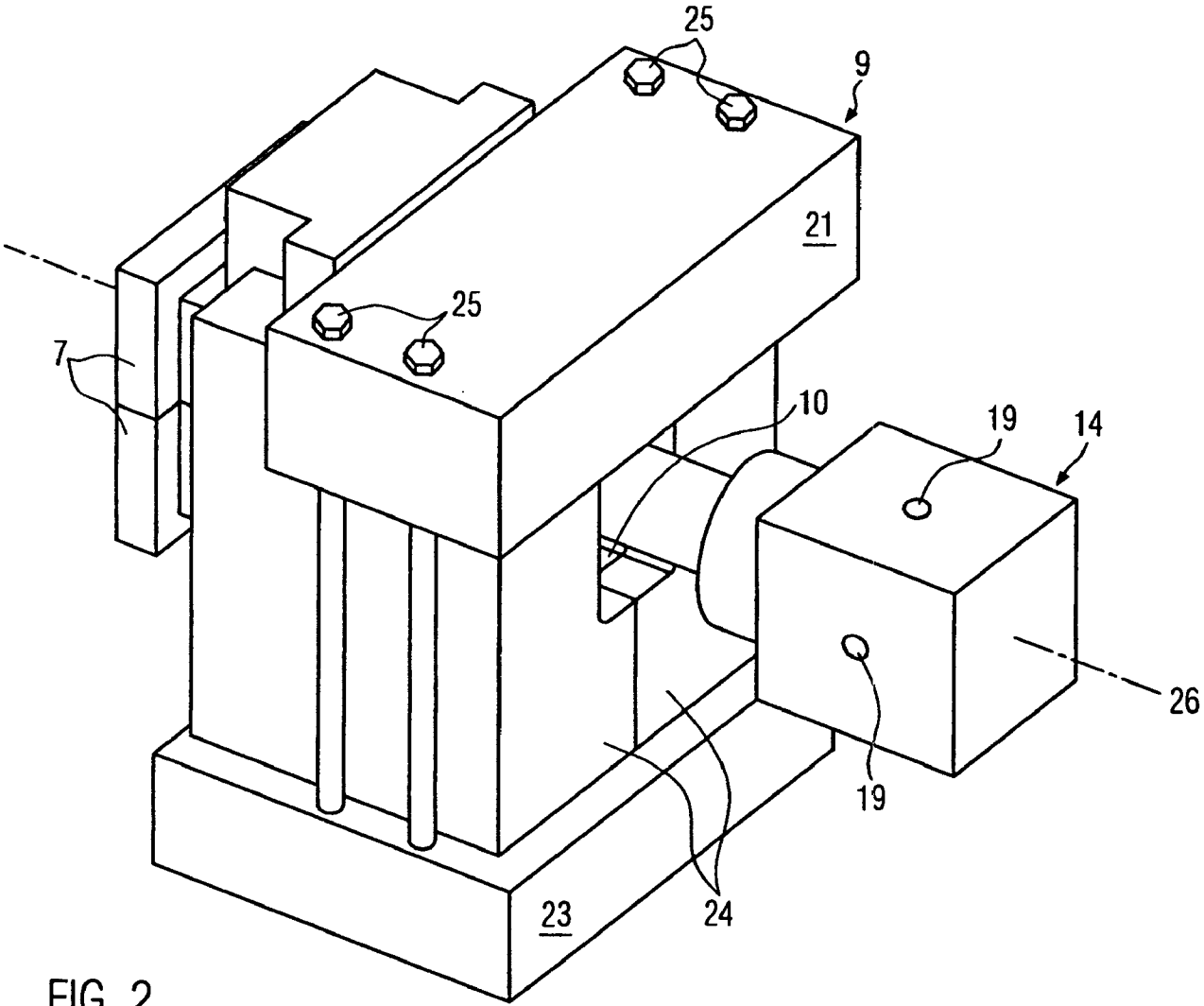
FIG. 2 shows a variant of the closure device in a perspective view.
Figure 3:
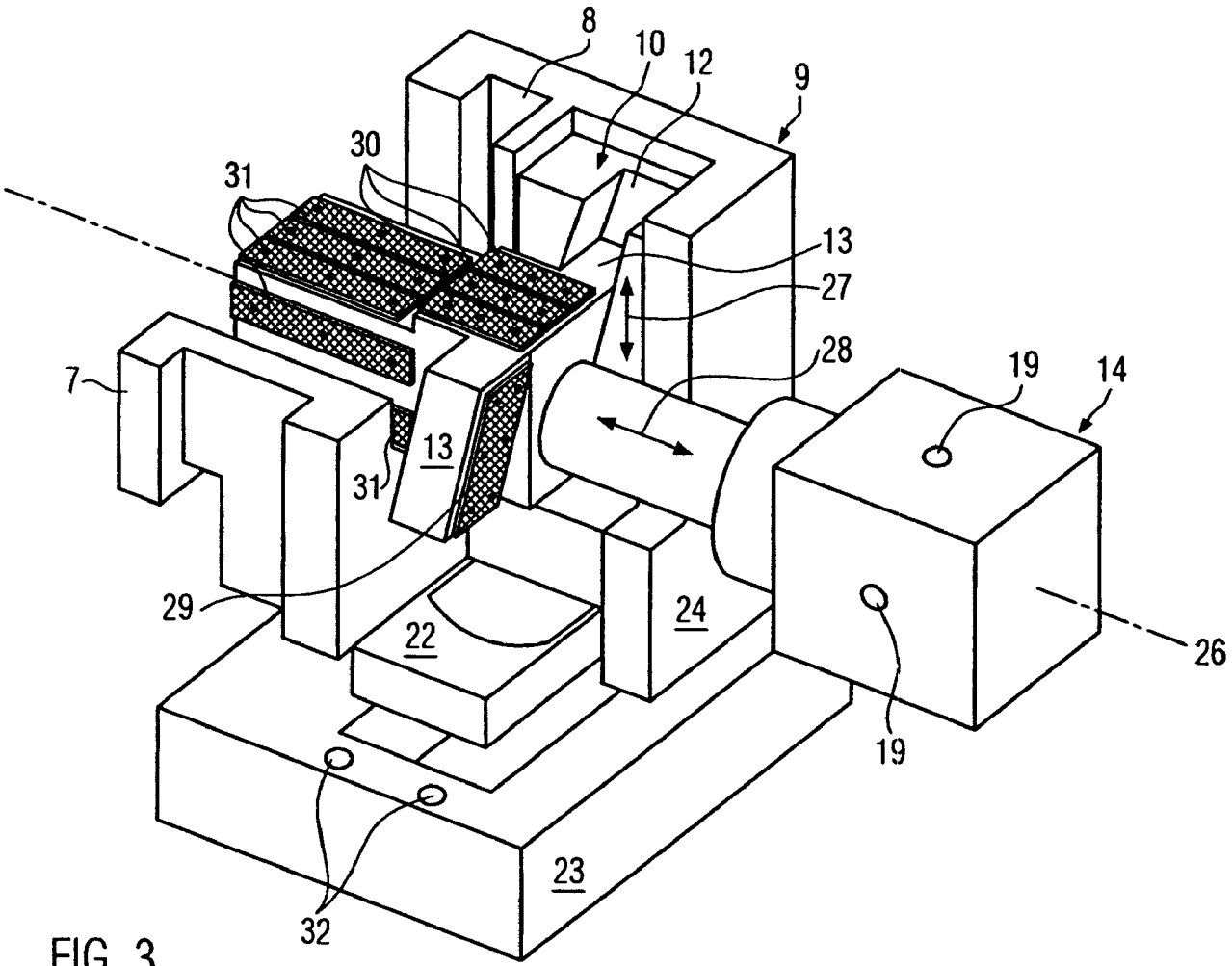
FIG. 3 shows part of the closure device for FIG. 2
Figure 4:
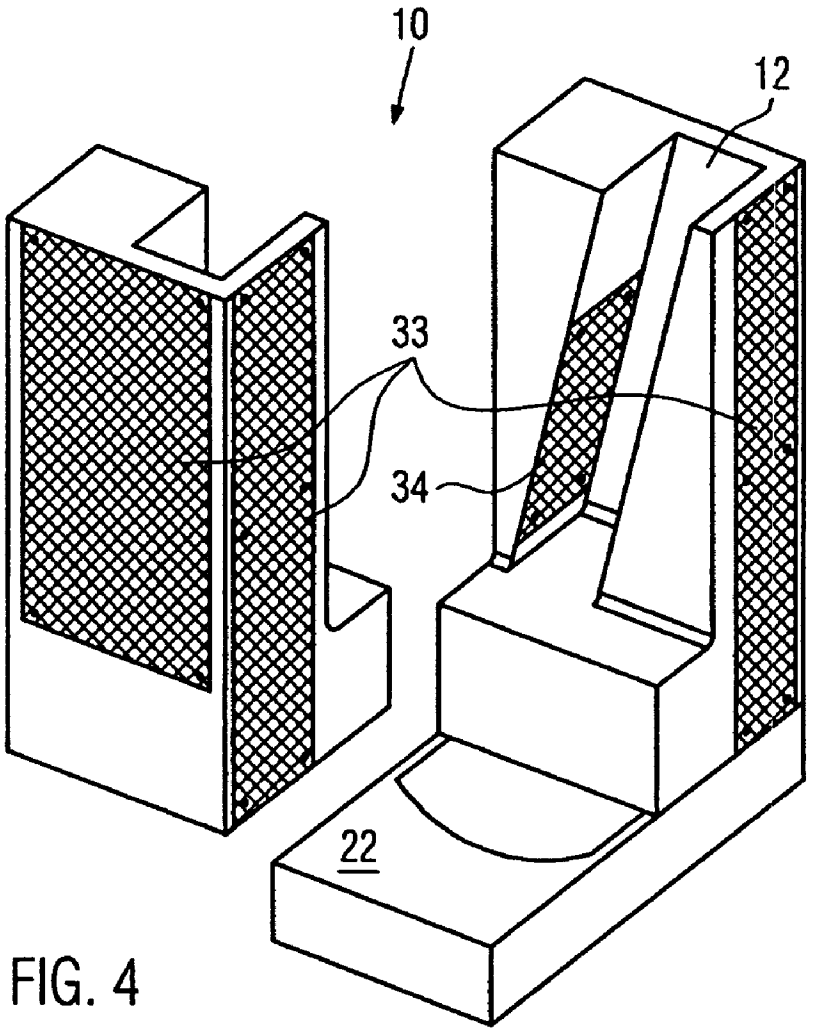
FIG. 4 shows the wedge structure of the closure device for FIG. 2 in detail.

An embodiment of the individual components of the closure device 1, especially the transfer elements 13, is apparent in detail from the following FIGS. 2 to 4.

For example, a yoke 21 and an actuator plate 22 are also only shown in the subsequent figures, in the interest of simplicity, for which reason plug 38 is not further discussed.

FIGS. 2 to 4 show examples of a variant of the invention. FIG. 2 shows the entire closure device 1 in a perspective, unsectioned view. The static holding structure 9 is designed multipart here. Side walls 24 are held between yoke 21, which is shown here as a cover wall of the static holding structure 9, and a bottom wall 23 by means of fastening elements 25. These side walls 24 enclose the wedge structure 10 roughly in annular fashion and together form the roughly frame-like connection unit 14, together with yoke 21 and wall 23, shown as the bottom.

The gas feed 19 is apparent on the connection unit 14. The anchoring element 7, formed in two parts here, is also apparent. The dash-dot line 26 shows the axis of the closure device 1 and, at the same time, the motion direction of the connection unit 14.

FIG. 3 shows the closure direction 1 from FIG. 2, in which yoke 21, fastening elements 25, one of the side walls 24 of the static holding structure 9 and the upper anchoring element 7 are not shown, which facilitates a view into the interior. The actuator plate 22 can now be seen, on which the hydraulic actuator 11 (not shown here) is mounted, in order to move the wedge structure 10. By movement 27 of wedge structure 10, a movement 28 of connection unit 14 occurs by forced coupling. Forced coupling occurs through transfer elements 13 guided in wedge guide 12. In order to facilitate sliding of wedge guide 12 on the side surfaces of transfer elements 13, both transfer elements have metallic antifriction coatings 29 on both sides. The side surfaces of the transfer elements 13 also have the same slope as the wedge guide 12. For reduction of friction, antifriction coatings 30, which are situated on the side of the connection unit 14 facing the yoke, are also situated on the sliding surface between the connection unit 14 and yoke 21. Additional, also metallic antifriction coatings 31 are situated on the connection unit 14 on the surfaces that move relative to anchoring element 7.

By omitting the upper anchoring element 7 in the drawing, FIG. 3 clearly shows guiding of the connection unit 14 in the anchoring element 7, as well as fastening of the anchoring element 7 in the shape-mated receptacle 8 of the static holding structure 9. A passage in the wall 23, shown as bottom, of the static holding structure 9 permits access to the hydraulic actuator 11 (not shown) via the actuator plate 22 to wedge structure 10. In the bottom wall 23, the mounts 32 of the fastening elements 25 of the static holding structure 9 are also apparent.

FIG. 4 shows the wedge structure 10 in detail. The actuator plate 22 is also shown, via which the wedge structure 10 is operated. A two-part wedge structure 10 can be seen here, as well as its antifriction coatings. The metallic antifriction coatings 33 are situated between the wedge structure 10 and the insides of the static holding structure 9 and there permit low-friction sliding during activation of wedge structure 10. In this variant additional antifriction coatings 34 are provided, which are situated on the surface of wedge structure 10, moved relative to transfer elements 13, and which therefore form the mating antifriction coatings of the antifriction coatings 29 to the transfer elements 13. As in the previous figure, in this variant the metallic antifriction coatings are screwed on, which is shown by small black circular surfaces.

A work piece to be formed is introduced to die 5, 6, which is closed, together with the two-part anchoring element 7, corresponding to upper 5 and lower box 6. The anchoring element 7 is then guided in the mount 8 aligned in the direction of the closure movement. For explosive forming of the work piece, the connection unit 14 is moved to the die 5, 6. For this purpose, the hydraulic actuator 11 operates the wedge structure 10 via actuator plate 22. The transfer elements 13, guided in the wedge guide 12 of wedge structure 10, together with the axial guide of connection unit 14 into the anchoring element 7, produce a movement of the connection unit to the forming die 5, 6. Because of the slope of wedge guide 12 relative to mount 8 of the anchoring element 7 and the movement direction 27 of wedge structure 10 and hydraulic actuator 11, axial offset of the connection unit 14 occurs in direction 28 toward die 5, 6.

An ignitable gas mixture is introduced through gas lines 35 and valves 20 by a gas feed and ignition system 19 into the work piece interior and ignited by ignition 39. The high recoil following the explosion acts against the operating direction on the connection unit 14, but is supported by the static holding structure 9 and partly diverted via its connection to the molding die 5, 6 via anchoring element 7, so that the forces can be used for sealing closure of the die 5, 6 by connection unit 14. After forming, the connection unit 14 is separated again from molding die 5, 6 in the rest position 18 by opposite movements of the hydraulic actuator 11 and wedge structure 10.

The invention claimed is:

1. A closure device for explosive forming of a work piece, the closure device comprising:

an explosive forming die defining a cavity for forming the work piece;

a connection unit being moveable relative to the explosive forming die along an axis between a working position wherein the connection unit is moved towards the explosive forming die for situating the connection unit on the explosive forming die and a rest position wherein the connection unit is moved away the explosive forming die;

a static holding structure disposed about at least a portion of the connection unit; and a wedge structure engaging the connection unit and disposed within the static holding structure and being moveable relative to the static holding structure transverse to the axis for moving the connection unit between the working position and the rest position.

2. The closure device according to claim 1, wherein the static holding structure encloses the wedge structure.

3. The closure device according to claim 2, further including sliding aids being provided on surfaces between the wedge structure and the static holding structure.

4. The closure device according to claim 3, wherein the sliding aids are metallic antifriction coatings.

5. The closure device according to claim 1, wherein the static holding structure is fastened to the explosive forming die.

6. The closure device according to claim 5, wherein the static holding structure is connected to the explosive molding die via at least one anchoring element.

7. The closure device according to claim 6, wherein the at least one anchoring element is mounted on the static holding structure in at least one shape-mated receptacle.

8. The closure device according to claim 6, wherein the movement of the connection unit relative to the explosive forming die is guided on the anchoring element.

9. The closure device according to claim 8, further including friction-reducing intermediate elements being provided on surfaces between the connection element and the anchoring element.

10. The closure device according to claim 9, wherein the friction-reducing intermediate elements are metallic antifriction coatings.

11. The closure device according to claim 1, wherein the wedge structure encloses the connection unit across transverse to the direction of movement of connection unit relative to the explosive forming die in a U-shaped manner.

12. The closure device according to claim 1, wherein the connection unit has at least one transfer element motion-coupled to the wedge structure transverse to the direction of movement of the connection unit relative to the explosive forming die, and being movable relative to the wedge structure for moving the connection unit between the working position and the rest position.

13. The closure device according to claim 12, wherein the wedge structure has at least one wedge guide for engaging the at least one transfer element.

14. The closure device according to claim 13, wherein the at least one transfer element and the at least one wedge guide are sloped in the same direction and to the same degree relative to the axis.

15. The closure device according to claim 14, further including slide-promoting intermediate structures being provided on surfaces between the at least one transfer element and the at least one wedge guide.

16. The closure device according to claim 15, wherein the slide-promoting intermediate structures are metallic antifriction coatings.

17. The closure device according to claim 1, wherein the wedge structure is moved by an operating element.

18. The closure device according to claim 17, wherein the operating element is a hydraulic actuator.

19. The closure device according to claim 17, wherein the operating element extends transversely through the wall of the static holding structure.

20. The closure device according to claim 1, wherein the closure device is releasably fastened as a unit to the explosive forming die.

21. The closure device according to claim 1, wherein the static holding structure has a ring-like closed structure.

22. The closure device according to claim 21, wherein the static holding structure is enclosed by a yoke.

23. The closure device according to claim 22, wherein the connection unit is supported to slide on the yoke.

24. The closure device according to claim 23, further including at least one sliding element disposed on at least one surface between the connection unit and the yoke.

25. The closure device according to claim 24, wherein the at least one sliding element includes a metallic antifriction coating.

26. The closure device according to claim 1, wherein the connection unit includes two transfer elements and the wedge structure includes two wedge guides transverse to the direction of movement of the connection unit.

27. The closure device according to claim 1, wherein the connection unit has at least one of a gas feed unit, an ignition device, a die closure, and a die seal.

* * * * *